US007908949B2

(12) United States Patent
Ogston

(10) Patent No.: US 7,908,949 B2
(45) Date of Patent: Mar. 22, 2011

(54) WINDSHIELD REMOVAL ASSEMBLY, METHOD AND BLADE FOR SAME

(75) Inventor: Alfred John Ogston, Calgary (CA)

(73) Assignee: Crystal Glass Canada Ltd., Edmonton (CA)

( * ) Notice: Subject to any disclaimer, the term of this patent is extended or adjusted under 35 U.S.C. 154(b) by 0 days.

(21) Appl. No.: 12/362,145

(22) Filed: Jan. 29, 2009

(65) Prior Publication Data

US 2009/0133548 A1 May 28, 2009

Related U.S. Application Data

(63) Continuation of application No. 11/414,131, filed on Apr. 28, 2006, now abandoned.

(51) Int. Cl.
*B26B 7/00* (2006.01)

(52) U.S. Cl. ..... 83/56; 30/169; 30/277.4; 30/357; 30/394; 30/500

(58) Field of Classification Search ..... 30/164.5–164.8, 30/167, 169, 171, 272.1, 277, 277.4, 357, 30/392–394, 500, 493; 15/236.01, 236.02, 15/236.03, 236.04, 236.05, 236.06, 236.07, 15/237–241, 236.09, 236.08; D32/40, 46; 173/30; 83/56, 945

See application file for complete search history.

(56) References Cited

U.S. PATENT DOCUMENTS

| | | | | |
|---|---|---|---|---|
| 508,273 | A | 11/1893 | Brauch | |
| 712,843 | A | 11/1902 | Paul | |
| 713,231 | A | 11/1902 | Mansbach | |
| 777,411 | A * | 12/1904 | Hall | 15/105 |
| 1,032,370 | A | 7/1912 | Bayley et al. | |
| 1,458,171 | A * | 6/1923 | Donaldson | 279/97 |
| 1,509,775 | A * | 9/1924 | Phillips | 30/125 |
| 2,139,769 | A | 12/1938 | Oslund | |
| 2,472,668 | A | 6/1949 | Lewandowski | |
| 2,621,614 | A | 12/1952 | Walling | |
| 2,800,672 | A | 7/1957 | Gilyan | |
| 3,092,411 | A | 6/1963 | Hardy | |
| 3,104,410 | A | 9/1963 | Ames | |

(Continued)

FOREIGN PATENT DOCUMENTS

CA 2191511 5/1998

(Continued)

OTHER PUBLICATIONS

Equalizer Auto Glass tools, 2006 Catalog, p. 7, 9, 11, 13.

(Continued)

*Primary Examiner* — Edward Landrum
(74) *Attorney, Agent, or Firm* — Greenlee Sullivan PC

(57) ABSTRACT

A windshield removal assembly, method and blade for same, with the thin metal blade having a unique delta-shape. The blade connects at its narrowed shank portion to the shaft of a reciprocating power tool. The blade has front and rear ends, the front end being substantially straight and wider than the blade rear end. The top edge of the blade forms a non-sharpened top edge on the front end and arc portions, while the bottom edge of the blade forms a sharpened bottom cutting edge which extends across the front end of the blade and along at least half of the arc portions. The blade has sufficient rigidity to cut the urethane bed when reciprocated, and sufficient lateral flexibility to conform to the curved surface of the windshield when pressed thereagainst.

13 Claims, 5 Drawing Sheets

U.S. PATENT DOCUMENTS

| | | | | |
|---|---|---|---|---|
| 3,267,516 | A | 8/1966 | Eckhaus | |
| 3,683,496 | A | 8/1972 | Johnson | |
| 3,853,495 | A | 12/1974 | Shire | |
| 4,080,734 | A | 3/1978 | Barbour | |
| 4,199,852 | A | 4/1980 | Ayers et al. | |
| 4,395,825 | A * | 8/1983 | Lock | 30/277.4 |
| 4,452,316 | A | 6/1984 | Edwards | |
| 4,598,476 | A | 7/1986 | Grasse | |
| 4,620,369 | A | 11/1986 | Gercken | |
| 5,040,614 | A | 8/1991 | Nash | |
| 5,042,592 | A | 8/1991 | Fisher | |
| 5,219,378 | A | 6/1993 | Arnold | |
| 5,251,352 | A | 10/1993 | Cullison | |
| 5,287,582 | A | 2/1994 | Kawai et al. | |
| 5,301,429 | A | 4/1994 | Bundy | |
| 5,421,230 | A | 6/1995 | Flaherty et al. | |
| 5,435,063 | A | 7/1995 | Russo | |
| 5,469,623 | A | 11/1995 | Roeker et al. | |
| 5,480,507 | A | 1/1996 | Arnold | |
| 5,606,761 | A * | 3/1997 | Lynch | 15/144.4 |
| 5,640,772 | A | 6/1997 | Roeker et al. | |
| 5,956,788 | A | 9/1999 | Henke | |
| 5,979,058 | A | 11/1999 | Henke | |
| 6,085,424 | A | 7/2000 | Mai | |
| 6,178,645 | B1 * | 1/2001 | Lock | 30/275.4 |
| 6,640,369 | B1 | 11/2003 | Malvasio | |
| 6,656,186 | B2 * | 12/2003 | Meckel | 606/82 |
| 6,862,968 | B1 * | 3/2005 | Ogston | 83/13 |
| 7,121,007 | B2 | 10/2006 | Ogston | |

FOREIGN PATENT DOCUMENTS

| | | |
|---|---|---|
| CA | 2305821 | * 10/2001 |
| DE | 4222250 | 1/1994 |

OTHER PUBLICATIONS

Equalizer Auto Glass tools, Website, www. autoglassolutions.com. Accessed Jun. 29, 2006.

U.S. Appl. No. 11/414,131, Nov. 1, 2007, Ogston.

* cited by examiner

WINDSHIELD REMOVAL ASSEMBLY, METHOD AND BLADE FOR SAME

CROSS REFERENCE TO RELATED APPLICATIONS

This application is a continuation of U.S. patent application Ser. No. 11/414,131, filed Apr. 28, 2006, which is incorporated herein by reference in its entirety to the extent not inconsistent herewith.

BACKGROUND OF THE INVENTION

This invention relates to a windshield removal assembly for cutting the urethane bed around the windshield perimeter and separating the glass windshield from the vehicle. The invention also relates to a method of removing a windshield with the assembly, and to a blade for use in the assembly.

In the process of securing a glass windshield to a new car or truck, the manufacturer first extrudes a bead or "bed" of urethane onto the "pinch weld" extending around the perimeter of the window opening. The urethane bed bonds to the pinch weld surface. The glass windshield then is seated on the bed and bonds to it, forming a liquid-tight seal. The urethane bed is hard and tough and not easily penetrated. It commonly has a thickness of about ¼ inch and width of about ⅓-¾ inches, widening to about 3½-4" or more at the corners.

If the windshield is to be replaced, an installer severs the bed along its length, just beneath the inside surface of the glass, leaving the base portion of the bed in place. He then primes the cut surface of the bed, deposits a new bead of urethane on the primed surface and seats the replacement windshield onto the fresh bead to bond it in place.

Up to about the end of the 1980's installers used a manually operated knife to sever the urethane bed. The knife was generally L-shaped, having a narrow sharpened blade and a shank or handle equipped with hand grips. The installer would first work the point of the blade inwardly to penetrate the bed and would then reciprocate the blade with short in and out strokes while pulling the blade sideways to saw through the urethane bed along its length. Commencing about 1990, two types of powered tools were introduced commercially, to replace the manually operated tools. These powered tools mimicked the manually operated knife in several structural and operational respects. The first type of tool involved an L-shaped blade and shank powered by an electric motor. The blade was oscillated from side to side. The blade was pointed at its end and narrow (about ½ inch wide), to facilitate initial manual penetration. The side edge of the blade was sharpened, so that a lateral cutting action was produced. The second type of tool involved reciprocating a blade which would extend in and out of a sleeve. The blade was actuated by an electric motor. Again, the blade was pointed and narrow (about ½ inch width), to facilitate initial penetration. The "throw" or distance advanced by the blade was short, about ½ inch.

In use, these tools were characterized by several problems. More particularly:

- Cutting with them was slow.
- The depth and width of the cut were small, requiring a great many cuts to complete the job.
- Typically it would take about 15-20 minutes to cut the windshield free.
- Using the prior art assemblies was laborious. The installer would have to apply a sideways pull to these tools, particularly when cutting along the horizontal legs of the bed.

- It was common to crack the glass when first penetrating the bed. This could leave broken glass on the dash and elsewhere, which was undesirable.
- The cuts made by the tools were shallow. One could only cut into the bed with these tools about ½ inch at a time. This meant that at the corners, where the bed width was greatest, it would take prolonged cutting to complete severing the bed. In practice, the installer would revert to using a hand knife at the corners or would break off the glass at the corners and have to later complete the cut by hand of the corner urethane with its embedded glass.
- In the course of hand cutting the corners, the installer would commonly press hard with his head against the windshield to assist his cutting—this was known to lead to neck injuries.
- The cut surface produced by the blades of these powered tools was irregular, tagged and undulating. This was undesirable as the newly extruded bead would in part reproduce this underlying irregularity and the new windshield would then not seat flush against the bed surface. This could lead to a poor seal and subsequent leaking.
- The electric motor-driven tools of the prior art were generally bulky and difficult to work with in confined space, such as the apex between the vehicle dashboard and the inside surface of the windshield.
- The prior art blades were fragile and expensive—breakage was a problem.
- It was necessary to use soapy water as a coolant and lubricant for the narrow, rapidly moving blades. After the cut was complete, the cut surface needed to be carefully washed to remove soap, as it was detrimental to getting a good bond when new urethane was laid on to the old bed.

Against this backdrop, the present inventor invented a windshield removal assembly including a modified reciprocating air gun which attached through a shaft to a unique, bell-shaped blade design which was wide at its front end and narrowed toward its rear (shank) end. The shank was connected to the reciprocating shaft of the air gun. This assembly and method of using same are described in U.S. Pat. No. 6,862,968, issued Mar. 8, 2005 to Ogston, and U.S. Published Patent Application No. 2005/0126359, published Jun. 16, 2005, also to Ogston.

While the above Ogston assembly was a marked improvement over many of the other prior art devices, it presented its own unique issues, as follows:

- The sharp corner edges at the front end of the blade could cause damage to either or both of the pinch weld of the vehicle holding the windshield, or to the dashboard or upholstery of the vehicle.
- Due to the extreme flexing requirements for the blade during use against the windshield, including twisting motions, the blade could break at the stress point between the bell shaped side edges of the blade and the straight shank side edges where the blade connected to the shaft.
- Penetration of the urethane bed, particularly at the corners where the bed is deepest, was sometimes still difficult.
- Cutting around the corners of the windshield presented some difficulty, with the sharp corners limiting movement around the corner.
- Cutting was primarily in the vertical (i.e., forward) direction, as the front end of the blade cut into the urethane bed. To move the blade along, particularly in the wider urethane bed at the bottom of the windshield, the installer would reposition the blade for each new cut into the urethane bed. While the wider blade made the operation much faster than with the prior art designs, it still took several minutes to remove the windshield.

In some newer vehicle designs the urethane bed has become wider as the windshield have moved to more aerodynamic designs. The bell-shaped blades could not be simply elongated to accommodate the needed deeper penetration without the blade becoming too fragile when flexed, i.e., if elongated beyond about 7.75 inches, the bell-shaped blades would break at their stress point (i.e., where the blade side edges joined to the shank).

The air gun, while suitable for some applications, did not meet all customer needs. Cordless and electrical power units were also desirable.

Canadian Patent Application No. 2,305,821, published Oct. 21, 2001 (now abandoned) to Hogg, describes a spade-shaped cutting blade similar to that of U.S. Pat. No. 6,862,968, for use with a reciprocating air gun. The front of the blade is shown to be slightly rounded, removing the sharp corners of the blade. As well, the blade is described as having an "offset" relative to the shaft of the air gun. To achieve the 900 offset, the blade is mounted on one flattened side of the shaft of the blade. This is stated to better support the blade against breakage at the shank. In the experience of the present inventor, simply "rounding" the corners of its own bell-shaped blade (U.S. Pat. No. 6,862,968) did not provide for clean continuous lateral cutting with the blade. As well, the "offset" mounting of the blade is not believed to allow the blade to be elongated without breakage at the stress point, as described above. Thus, to the present inventor's knowledge, the blade design of CA Patent Application 2,305,821 was never commercialized, nor is it believed to adequately answer the issues listed hereinabove with the bell-shaped blades of U.S. Pat. No. 6,862,968.

SUMMARY OF THE INVENTION

The preferred windshield removal assembly of the invention involves combining the following features:

a) using a reciprocating power tool, whether it be an air gun, cordless or electrical reciprocating unit, equipped with a modified shaft having attachment means at its outer end for attaching to a replaceable cutting blade; a shaft length to sufficiently space the blade from the power tool to allow the assembly to be operated within the confines of the apex space formed between the windshield and the vehicle dash; and ability to deliver a high impact blow with a preferred stroke length of about ½ inch, such that the blade moves substantially co-planar with the shaft; and b) providing a flat, thin metal cutting blade with the following features:

i. front and rear ends, the front end being substantially straight and wider than the blade rear end, the rear end being connected through a shank portion of the blade to the shaft's outer end such that the blade is held substantially co-planar with the shaft;

ii. substantially straight side edges which narrow from the front end to the rear end to about the width of the shaft;

iii. an arc portion between the front end and each side edge, the arc portion having a radius of curvature between 0.60 and 1.0 inches;

iv. a non-sharpened top edge on the front end and arc portions, the top edge being configured such that it can be pressed against the windshield;

v. a sharpened bottom cutting edge formed on and extending across the front end of the blade and along at least half of the arc portions adjacent the front end, the cutting edge being sufficiently sharp to penetrate the urethane bed when reciprocated with sufficient force from the power tool; and vi. sufficient rigidity to cut the urethane bed when reciprocated, and sufficient lateral flexibility to conform to the curved surface of the windshield when pressed there against.

In order to strengthen the blade against breakage at the stress point where the blade side edges meet the shank, particularly for blades longer than 6 inches, the invention preferably includes a further blade design feature as follows: the blade shank portion is formed with spaced shank side edges substantially parallel with the shaft, and the blade side edges meet the shank side edges at an angle between about 5 and 25 degrees. This angle is reduced over that in the prior art bell-shaped blade design, and that shown in patent application to Hogg. With this reduced angle range, blades as long as about 9 inches may be accommodated.

The most preferred dimensions of the delta-shaped blade of this invention will vary depending on the particular application (ex. urethane bed width and apex dimensions adjacent the windshield being removed) and the power tool being used (which will vary the desired blade length and the shank dimensions). Preferred dimensions determined by the inventor include:

blade length—2.75 to 4.25 inches, most preferably 4 inches;

blade lengths—6 to 9 inches, most preferably 8 inches;

radius of curvature of arc portions—0.60 to 1.0 inches, more preferably 0.75 to 0.90, most preferably 0.85 to 0.875;

enclosed angle of arc portions—65 to 80 degree, more preferably 70 to 75 degrees; and shank angle (where blade side edges meet the shank)—5-25 degrees, more preferably 10 to 25 degrees.

It has been found that this combination provides a cutting assembly having the following attributes:

Blade breakage is reduced.

Blades may be elongated without breakage when the blades are flexed, even in the lateral directions.

The longer blades allow for deeper penetration into wider urethane beds.

The sharpened bottom cutting edge extending around the arc portions make cutting easier for the installer, allowing for more continuous lateral cutting movement without repositioning the blade between cuts. This results in faster windshield removal times and reduced injuries to the installer.

The sharpened arc portions make cutting around the corners of windshield easier, with less damage to windshield, vehicle, and pinch mold, and leave a clean urethane bed for attachment of the new windshield.

The invention also broadly extends to cutting blades as described above, and to a method of cutting a urethane bed with the windshield removal assembly as described above. The method broadly includes:

providing a windshield removal assembly as defined in any one of claims 1 to 5;

positioning the windshield removal assembly in the apex space with the blade being positioned such that the non-sharpened edge is pressed against the windshield, the blade is flexed to follow the curved surface of the windshield, and the sharpened cutting edge at the front end of the blade is pressed against the urethane bed;

reciprocating the blade with the power tool to make an initial incision into the urethane bed; and continuing to reciprocate the blade while moving the blade and power tool in a generally continuous lateral movement using the sharpened cutting edge at both the front end and arc portions of the blade to cut the urethane bed around the perimeter of the windshield.

DEFINITIONS

As used herein and in the claims, the term "reciprocating" refers to a back and forth movement along the longitudinal axis of the shaft of the power tool.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

DETAILED DESCRIPTION OF THE INVENTION

Figure 1:
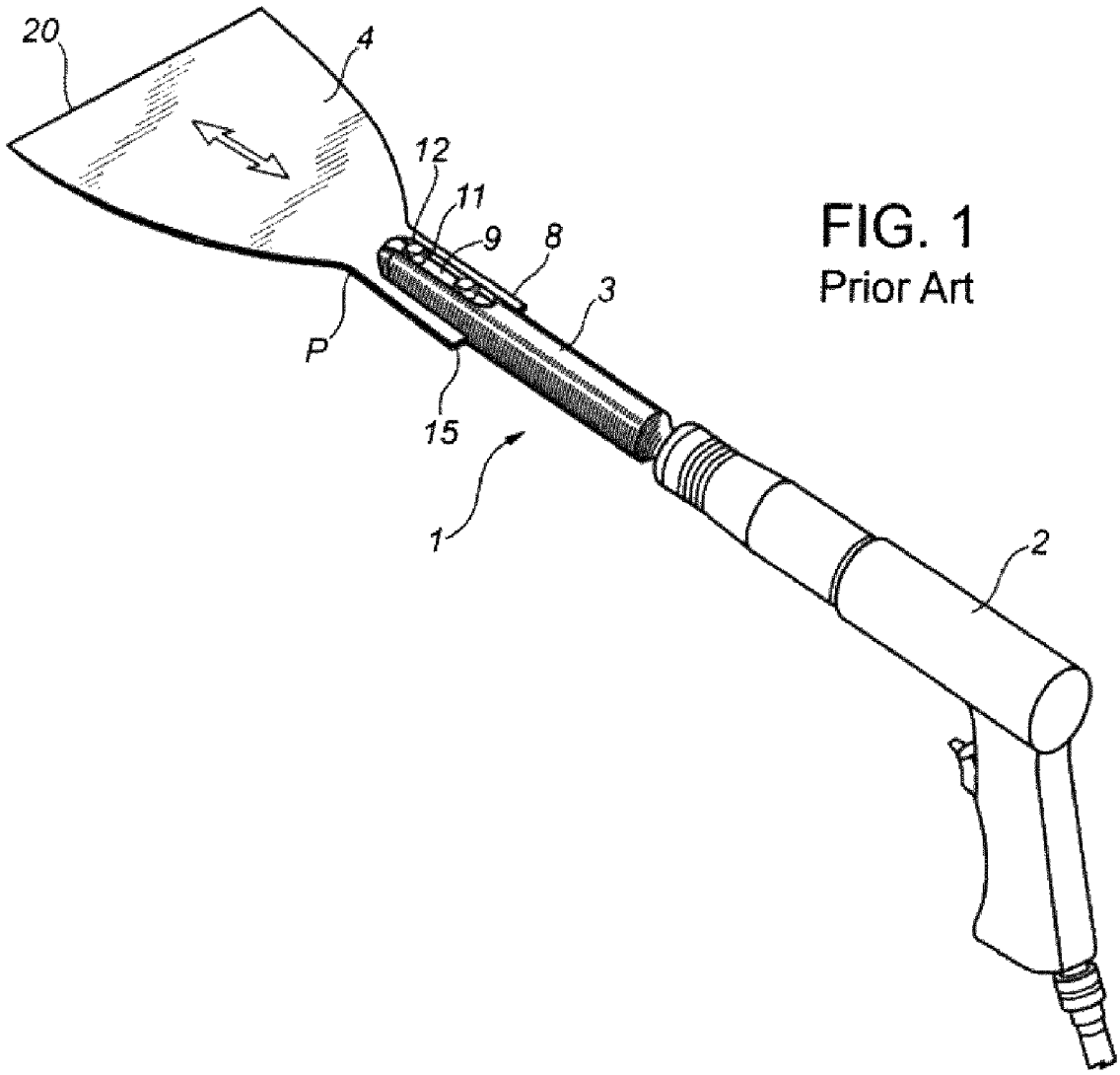
FIG. 1 Prior Art
FIG. 1 is an perspective view of a prior art windshield removal assembly showing a bell shaped blade connected for reciprocation to an air gun.

The windshield removal assembly 1 comprises a reciprocating power tool, such as an air gun 2, shaft 3 and blade 4. FIG. 1 shows the inventor's prior art version of the windshield removal assembly as described in U.S. Pat. No. 6,862,968 and U.S. Published Application No. 2005/0126359, wherein the power tool is an air gun 2, the shaft 3 reciprocates in a back and forth movement along the longitudinal axis of the shaft 3. The blade 4 is shown with its bell-shaped configuration. The stress point mentioned above, at the joining of the side edges to the shank, is shown at P.

The present invention is shown in FIGS. 2-7, with like parts, compared to the prior art device of FIG. 1, being labeled with the same numerals.

Figure 2:
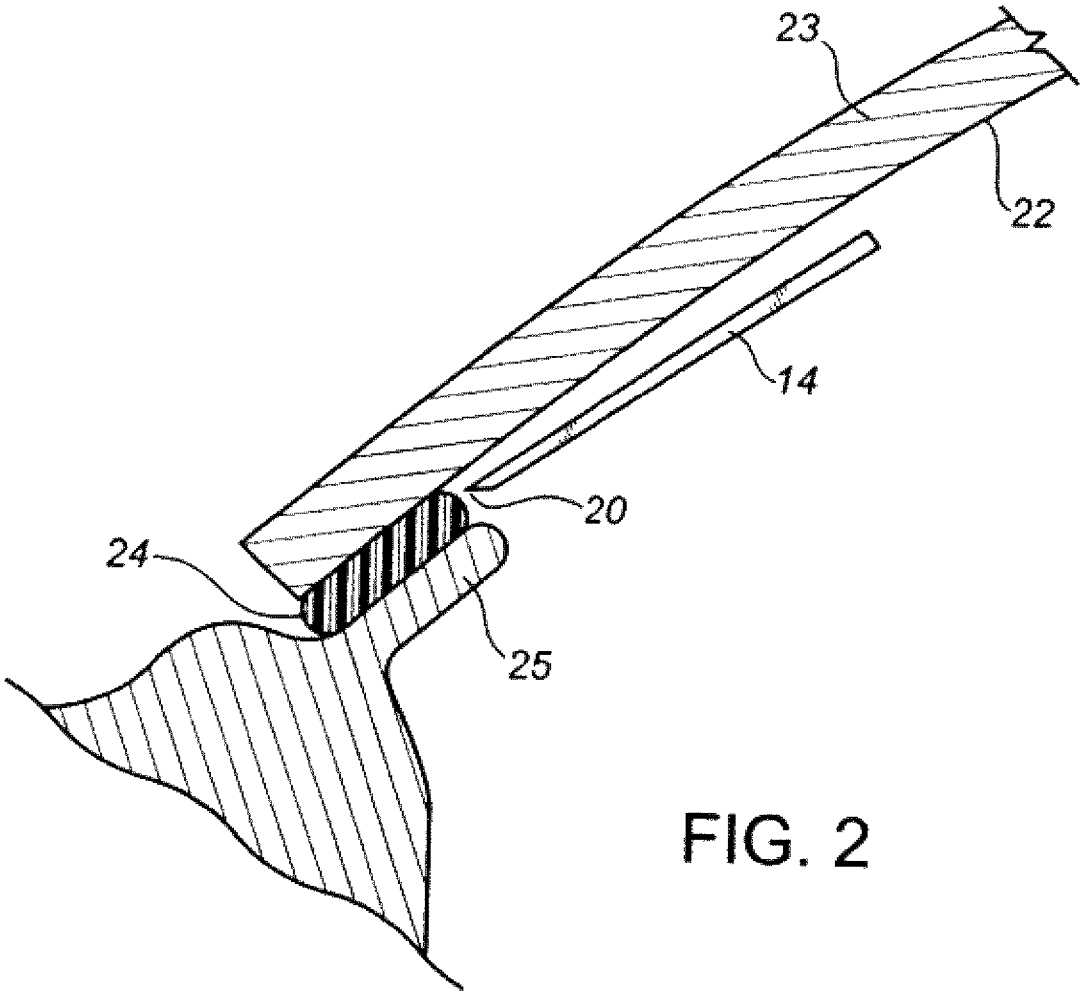
FIG. 2 is a schematic side view showing the position of the blade of the present invention for cutting the urethane bed around the perimeter of a windshield.

FIG. 2 is schematic in nature, and is of assistance in describing the operation of assembly of the present invention. When assembled and operated, the blade 14 preferably reciprocates with a throw or travel of about ½ inch. The blade 14 is pressed against the inside surface 22 of the glass windshield 23 and is driven into the urethane bed 24. It severs the urethane bed 24 just beneath the glass perimeter. With the prior art device described above, the installer would move the assembly 1 along the length of the bed 24 by withdrawing the blade 4 from the urethane bed 24, moving it to the next adjacent cut position and then again driving the blade in. With the assembly 13 of the present invention, as will be evident from this description, the newly designed delta-shaped blade 14 can be moved along with continuous cutting in the lateral direction through the urethane bed 24, without the need to re-position and move it for each next adjacent cut. As described below, in the present invention, the large rounded corners (arc portions 31), combined with the sharpened cutting edge 30 which extends a substantial distance around the arc portions 31, allow the blade 14 to be moved smoothly in the lateral direction, even at the corners of the windshield, for cutting in the both the vertical (i.e., forward) and lateral directions. The installer can also use water without lubricant as a cooling agent while cutting the urethane bed 24.

Suitable reciprocating power tools are commercially available to deliver high impact strokes with about a ½ inch throw. These power tools may be modified to provide a suitable shaft 3 to retain the blade 14, and to space the blade sufficiently from the power tool in order to fit within the narrow vehicle apex adjacent the windshield. For instance, for an air gun, a CHICAGO PNEUMATIC model # CP715 air gun is suitable. Suitable cordless power tools include, for example, a MILWAUKEE MAX 18 (18 volt), DEWALT 18 volt, or DEWALT 24 volt BRUTE model cordless power tool. A suitable electric power tool is, for example, a MILWAUKEE 120 volt model electric power tool. Shaft dimensions will vary with the particular application and power tool, but will generally range from 5 to 13 inches in length, and 0.70 to 0.80 inches in diameter (at the shaft outer end 6).

Figure 3:
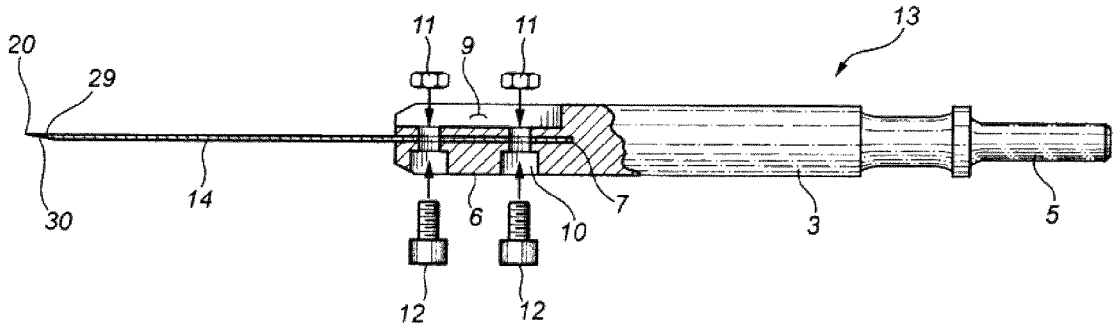
FIG. 3 is a side view of the shaft attachment to the blade.
Figure 4:
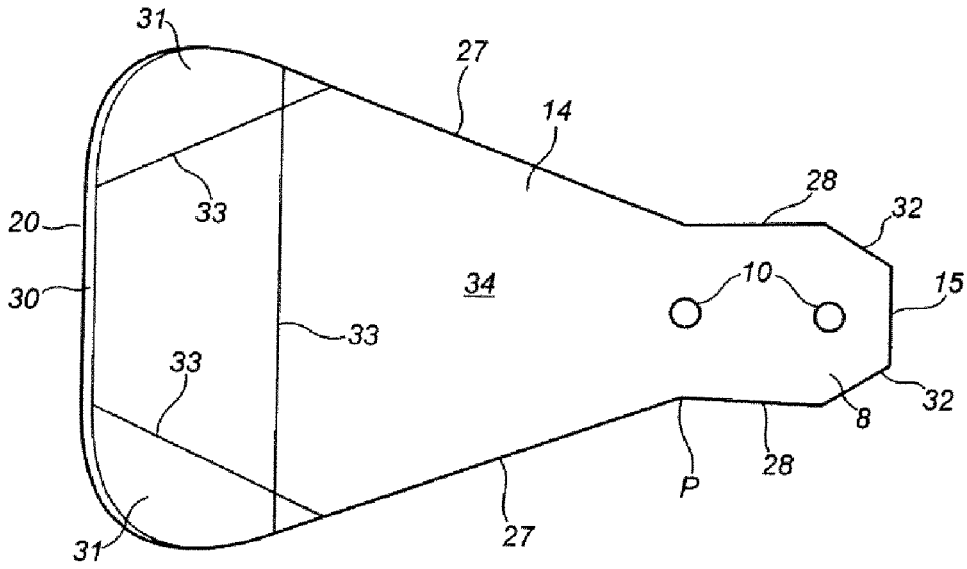
FIGS. 4-7 are bottom plan views of four different sized blades of the present invention (6, 7, 8 and 9 inch long blades respectively), showing the sharpened bottom cutting edge extending across the front edge and across the arc portions adjacent the front edge, and also showing the preferred feature of a reduced angle at which the blade side edges meet the blade shank portion.

Turning to FIG. 3, the shaft 3 is shown as a ¾ inch diameter steel rod having an inner end 5 conventionally shaped to connect with the air gun 2 (or other power tool). At its outer end 6, a slot 7 extends inwardly to receive the shank portion 8 formed at the rear end 15 of the blade 14. The upper surface of the rod end 6 forms a recess 9. The rod end 6 further forms bolt holes 10 extending transversely therethrough. Nuts 12 and bolts 11 are received in the recess 9 and holes 10 to secure the blade shank 8 to the rod end 6.

Figure 5:
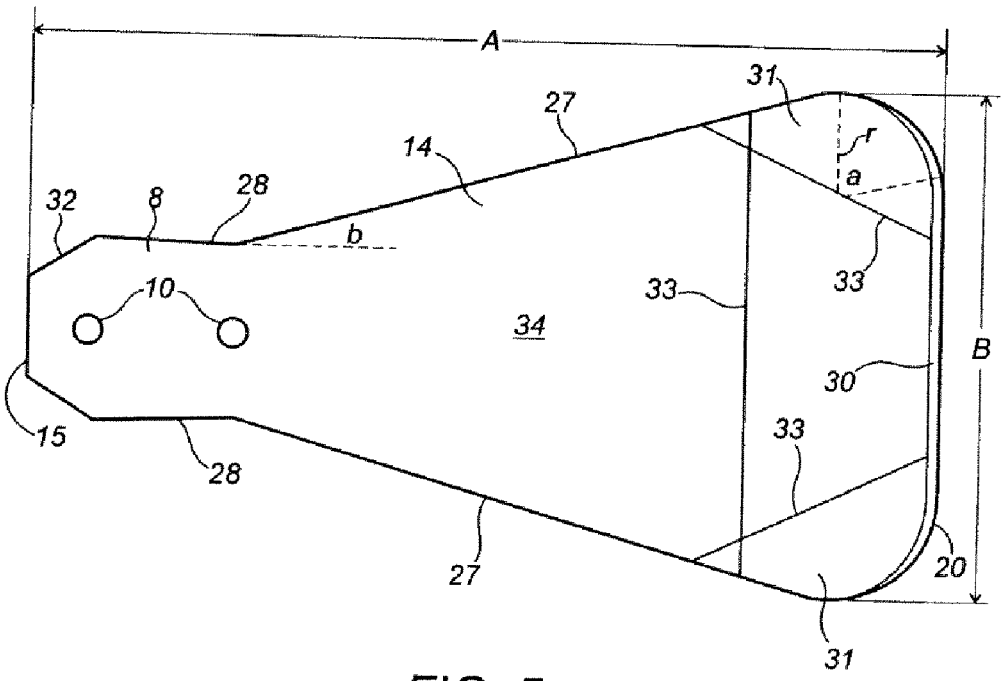

The blade 14 is formed of thin metal, preferably stainless steel, and has a width at the front end 20 which is significantly wider than the width of its rear end 15. Preferably the front end 20 has a width in the range of about 2.75 to 4.25 inches, most preferably about 4 inches, measured as shown for dimension B in FIG. 5. The preferred length of the blade 14, shown as dimension A in FIG. 5 is 6-9 inches, with 8 inches being most preferred. The shank 8 is shown to include squared off corners 32 to prevent sharp corners. The blade thickness is preferably about 0.05 inches, tapering to 0.025 inches at the sharpened cutting edge 30. While it is substantially rigid, it also has sufficient lateral flexibility so that it will conform to the windshield curvature when pressed thereagainst. The blade shank 8 is generally sized to be close to the dimensions of the shaft 3. As shown in the preferred blades sizes of FIGS. 4-7 (lengths 6, 7, 8 and 9 inches respectively), the shank 8 has substantially parallel side edges 28. These side edges 28 are shown as being most preferably spaced apart by 1.375 inches, and the shank length is most preferably 1.5625 inches. This shank length (measured from the midpoint of the front most hole 10 to the rear end 15 of the blade) is reduced compared to the prior art bell-shaped blade, such that the shaft outer end 6 extends slightly past the blade end of the shank 8. This increases both the strength and support for the shank 8 at this point. As mentioned, these shank dimensions may vary with the diameter of the shaft 3, which in turn varies with the particular power tool being used to reciprocate the blade 14.

Unlike the bell-shaped blades 4 of the prior art, the blade 14 of this invention has straight side edges 27 between the arc portions 31 and the shank 8. The side edges 27 narrow the blade 14 from its front to rear ends 20, 15. The blade front end 20 is beveled on one side only to produce a top non-sharpened edge 29 which bears against the glass of the windshield without damaging the windshield, and a bottom sharpened cutting edge 30 which penetrates the urethane bed 24 when the assembly 13 is in use. Between the blade front end 20 and the side edges 27, are formed arc portions 31, each having a radius of curvature "r" of between 0.60 and 1.0 inches, more preferably 0.75 to 0.90, and most preferably 0.85 to 0.875. The arc portions 31 are of significant size, and are not a mere "rounding off" of the corners, as suggested by the prior art. The angle enclosed by the arc portions 31 is shown as angle "a" in FIG. 5. This angle "a" is preferably in the range of 65 to 80 degrees, more preferably 70 to 75 degrees. Importantly, the sharpened bottom cutting edge 30 extends continuously across the front end 20 of the blade 14, and at least across half of the arc portions 31. More preferably the cutting edge 30 extends completely across the arc portions 31, as shown in FIGS. 4-7.

These combined features at the front of the blade 14 (the large arc portions 31 and the cutting edge 30 extending substantially around the arc portions 31) provide the blade 14 with the ability to cut in a continuous lateral manner for a majority of the windshield, without having to reposition the blade between each cut. The sharpened arc portions 31 also allow the blade 14 to be maneuvered in cutting mode around the corners of the windshield without difficulty, and without damaging the pinch weld, the windshield or the vehicle. These combined features significantly ease the cutting operation, reduce the time to remove a windshield, and allow the blade 14 to be used in elongated forms in the wider urethane beds of today's vehicles.

Figure 6:
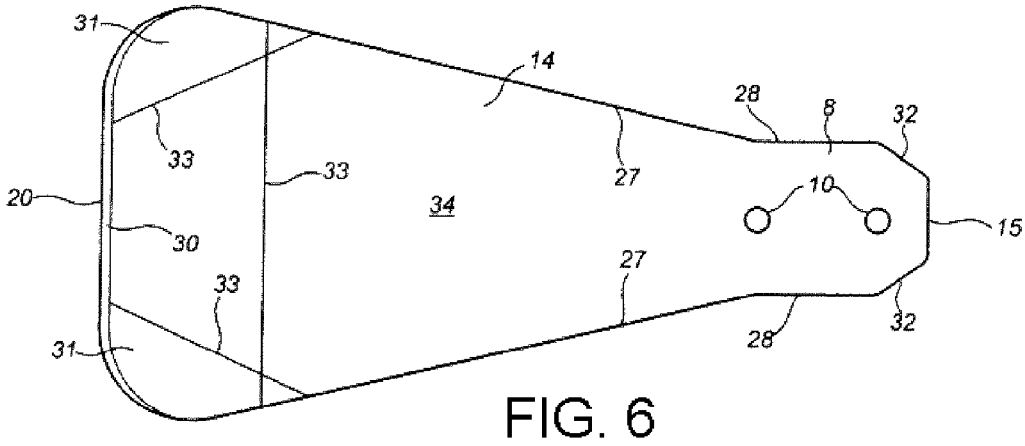
Figure 7:
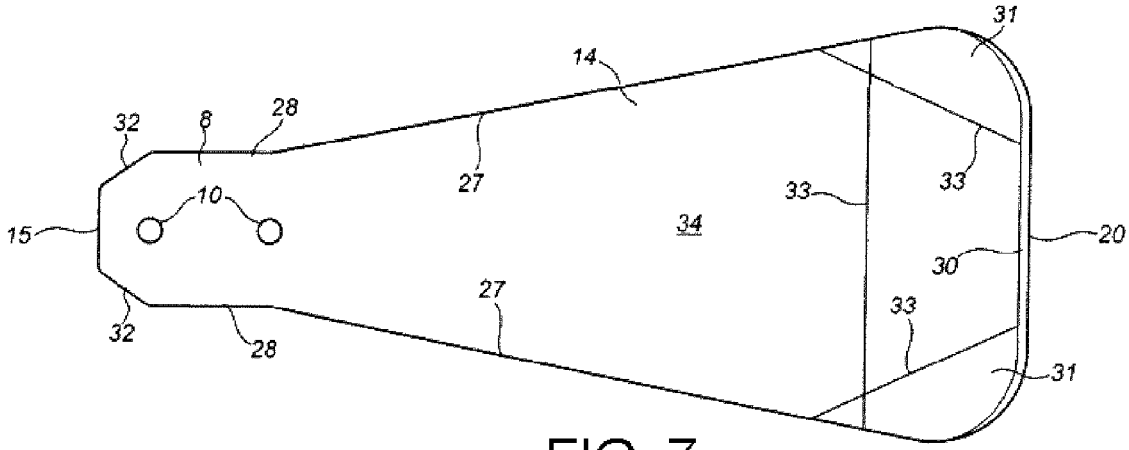

As shown in FIGS. 4-7, the shank portion 8 of the blade includes parallel spaced side edges 28, spaced apart by about the width of the shaft 3. At the point where the shank edges 28 meet the blade side edges 27 there is stress in the blade, particularly as it is laterally flexed in operation. To strengthen the blade 14 at this stress point P, the angle "b" at which the shank edges 28 meet the blade side edges 27 is reduced to be within the range of 5 to 25 degrees. This angle b is generally at the smaller end of the range for the longer blades (FIG. 7 shows a 9 inch blade) and with blades having smaller widths at their front edges. The angle "b" is generally at the higher end of the range for the shorter blades (FIG. 6 shows a 6 inch blade) and with blades having the wider widths at their front edges (FIGS. 4-7 show 4 inch width blades). By reducing the shank angle "b" as described, much longer blades may be produced (up to 9 inches) than was possible with the prior art bell-shaped blades (limited to about 7.75 inches).

This reduced shank angle "b" is significantly less than that of U.S. patent to Ogston, and CA Patent Application to Hogg, which show shank angles greater than about 30 degrees. As well, the arc portions 31 are much larger, and sharpened compared to those of the Hogg patent application, enabling cutting around the windshield corners, and continuous cutting in a lateral direction, using the sharpened cutting edge 30 on both the front end and the arc portions.

Also as shown in FIGS. 4-7, the blade 14 is preferably provided with score lines 33 on its bottom surface 34 to show the maximum insertion depths into the urethane bed 24. Being located on the bottom of the blade, these guidelines 33 remain visible to the installer during operation, and serve to protect the pinch weld 25 against damage.

All publications mentioned in this specification are indicative of the level of skill in the art of this invention. All publications are herein incorporated by reference to the same extent as if each publication was specifically and individually indicated to be incorporated by reference. The terms and expressions used are, unless otherwise defined herein, used as terms of description and not limitation. There is no intention, in using such terms and expressions, of excluding from the claims, equivalents of the features illustrated and described. A person skilled in the art could make immaterial modifications to the invention described in this patent document without departing from the essence of the invention. Although the best mode contemplated for carrying out the present invention has been herein shown and described, it will be apparent that modification and variation may be made without departing from what is regarded to the subject matter of the invention, as defined in the claims.

I claim:

1. A windshield removal assembly for cutting a urethane bed securing the perimeter of a glass windshield to a vehicle at an edge of a windshield opening formed by the vehicle, wherein the windshield has a curved surface and wherein there is a narrowing apex space between the windshield and a vehicle part forming the windshield opening, the assembly comprising:

a reciprocating power tool;

a cutting blade;

a rigid elongated shaft having inner and outer ends, the inner end being adapted for connection with the power tool for reciprocation thereby, and the outer end being adapted for connection to the cutting blade;

the cutting blade being a flat, thin metal blade having:

a front end and a rear end, the blade front end being substantially straight and being wider than the blade rear end, the blade rear end being adapted for connection through a shank portion of the blade to the shaft's outer end such that the blade is held substantially co-planar with the shaft;

straight side edges which narrow from the front end to the rear end to about the width of the shaft, the blade shank portion having spaced shank side edges substantially parallel with the shaft, and wherein the blade side edges meet the shank side edges at an angle between 5 and 25 degrees, an arc portion between the front end and each side edge, the arc portion having a radius of curvature between about 0.60 and 1.0 inches;

a non-sharpened top edge on the front end and arc portions, the top edge being configured such that it can be pressed against the windshield;

a sharpened bottom cutting edge formed on and extending across the front end of the blade and along at least half of the arc portions adjacent the front end, the bottom cutting edge being sufficiently sharp to penetrate the urethane bed when reciprocated with sufficient force from the power tool; and sufficient rigidity to cut the urethane bed when reciprocated, but sufficient lateral flexibility to conform to the curved surface of the windshield when pressed thereagainst; and the shaft having a length sufficient to space the blade from the power tool to allow the assembly to be operated within the confines of the apex space.

2. The assembly of claim 1, wherein the blade has a length of about 6 to 9 inches and a blade width at its widest point of about 2.75 to 4.25 inches, wherein the arc portions each enclose an angle of about 65 to 80 degrees and have a radius of curvature of about 0.75 to 0.90 inches, and wherein the sharpened cutting edge extends around substantially the entire edge of the arc portions.

3. The assembly of claim 2, wherein the arc portions each enclose an angle of about 70 to 75 degrees and have a radius of curvature of about 0.85 to 0.875 inches, and the blade side edges meet the shank side edges at an angle between 10 and 25 degrees.

4. The assembly of claim 3, wherein the blade is about 7 to 9 inches in length, and has a blade width at its widest point of about 4 inches.

5. The assembly as defined in claim 1, wherein the blade is formed with one or more guidelines on the bottom of the blade spaced from the bottom cutting edge to show maximum insertion depth of the blade during operation.

6. The assembly of claim 1, wherein the blade shank portion has a length that allows the outer end of the shaft, when connected to the blade, to extend forwardly beyond the point where the blade side edges meet the shank side edges to increase strength and support for the blade.

7. A blade as defined in claim 1.

8. A method of cutting a urethane bed securing the perimeter of a glass windshield to a vehicle at the edge of a windshield opening formed by the vehicle, wherein the windshield has a curved surface and wherein there is a narrowing apex space between the windshield and a vehicle part forming the windshield opening, the method comprising:

providing a windshield removal assembly as defined in claim 1;

positioning the windshield removal assembly in the apex space with the blade being positioned such that the non-sharpened edge is pressed against the windshield, the blade is flexed to follow the curved surface of the windshield, and the sharpened cutting edge at the front end of the blade is pressed against the urethane bed;

reciprocating the blade with the power tool to make an initial incision into the urethane bed; and continuing to reciprocate the blade while moving the blade and power tool in a generally continuous lateral movement using the sharpened cutting edge at both the front end and arc portions of the blade to cut the urethane bed around the perimeter of the windshield.

9. The method of claim 8, wherein the blade has a length of about 6 to 9 inches and a blade width at its widest point of about 2.75 to 4.25 inches, wherein the arc portions each enclose an angle of about 65 to 80 degrees and have the radius of curvature of about 0.75 to 0.90 inches, and wherein the sharpened cutting edge extends around substantially the entire edge of the arc portions.

10. The method of claim 9, wherein the arc portions each enclose an angle of about 70 to 75 degrees and have the radius of curvature of about 0.85 to 0.875 inches, and the blade side edges meet the shank side edges at an angle between 10 and 25 degrees.

11. The method of claim 10, wherein the blade is about 7 to 9 inches in length, and has a blade width at its widest point of about 4 inches.

12. The method as defined in claim 8, wherein the blade is formed with one or more guidelines on the bottom of the blade spaced from the bottom cutting edge to show a maximum insertion depth of the blade during operation.

13. The method of claim 8, wherein the blade shank portion has a length that allows the outer end of the shaft, when connected to the blade, to extend forwardly beyond the point where the blade side edges meet the shank side edges to increase strength and support for the blade.

* * * * *